United States Patent [19]

Finney et al.

[11] 4,403,360

[45] Sep. 13, 1983

[54] DISTRIBUTOR FOR GEL SYSTEMS TO FORM SHARPLY DELINEATED COLOR PATTERNS UPON TEXTILE SURFACES

[75] Inventors: Michael L. Finney, Charlotte, N.C.; Danny Moates, Cohutta, Ga.; Michael R. Brown, Louisville, Ky.

[73] Assignee: Celanese Corporation, New York, N.Y.

[21] Appl. No.: 250,480

[22] Filed: Apr. 2, 1981

[51] Int. Cl.[3] ..... D06B 1/06; D06B 11/00

[52] U.S. Cl. ..... 8/151; 68/205 R

[58] Field of Search ..... 8/149, 151; 68/200, 68/205 R; 118/324, 325

[56] References Cited

U.S. PATENT DOCUMENTS

| | | | |
|---|---|---|---|
| 3,541,815 | 11/1970 | Appenzeller et al. | 68/22 R |
| 3,683,649 | 8/1972 | Takriti et al. | 68/5 D |
| 3,718,427 | 2/1973 | Ahrweiler | 8/151 |
| 3,726,640 | 4/1973 | Takriti et al. | 8/149 |
| 3,731,503 | 5/1973 | Appenzeller et al. | 68/205 R |
| 3,909,191 | 9/1975 | McCoy | 8/473 |
| 4,146,362 | 3/1979 | Nichols, Jr. | 8/485 |
| 4,254,644 | 3/1981 | Bartlett et al. | 68/205 R |
| 4,264,322 | 4/1981 | Lewis et al. | 8/479 |

FOREIGN PATENT DOCUMENTS

| | | | |
|---|---|---|---|
| 19035 | 11/1980 | European Pat. Off. | 68/205 R |
| 1288681 | 9/1972 | United Kingdom | 68/205 R |
| 1296725 | 11/1972 | United Kingdom | 68/205 R |

*Primary Examiner*—Philip R. Coe

*Attorney, Agent, or Firm*—Depaoli & O'Brien

[57] ABSTRACT

A modified Kuester apparatus and a method for forming patterns of immiscible gels and of immobilized gels on a doctor blade functioning as a viewing screen before the gel pattern is deposited on a carpet are described. The preferred angle for the doctor blade is 30°–40°.

4 Claims, 1 Drawing Figure

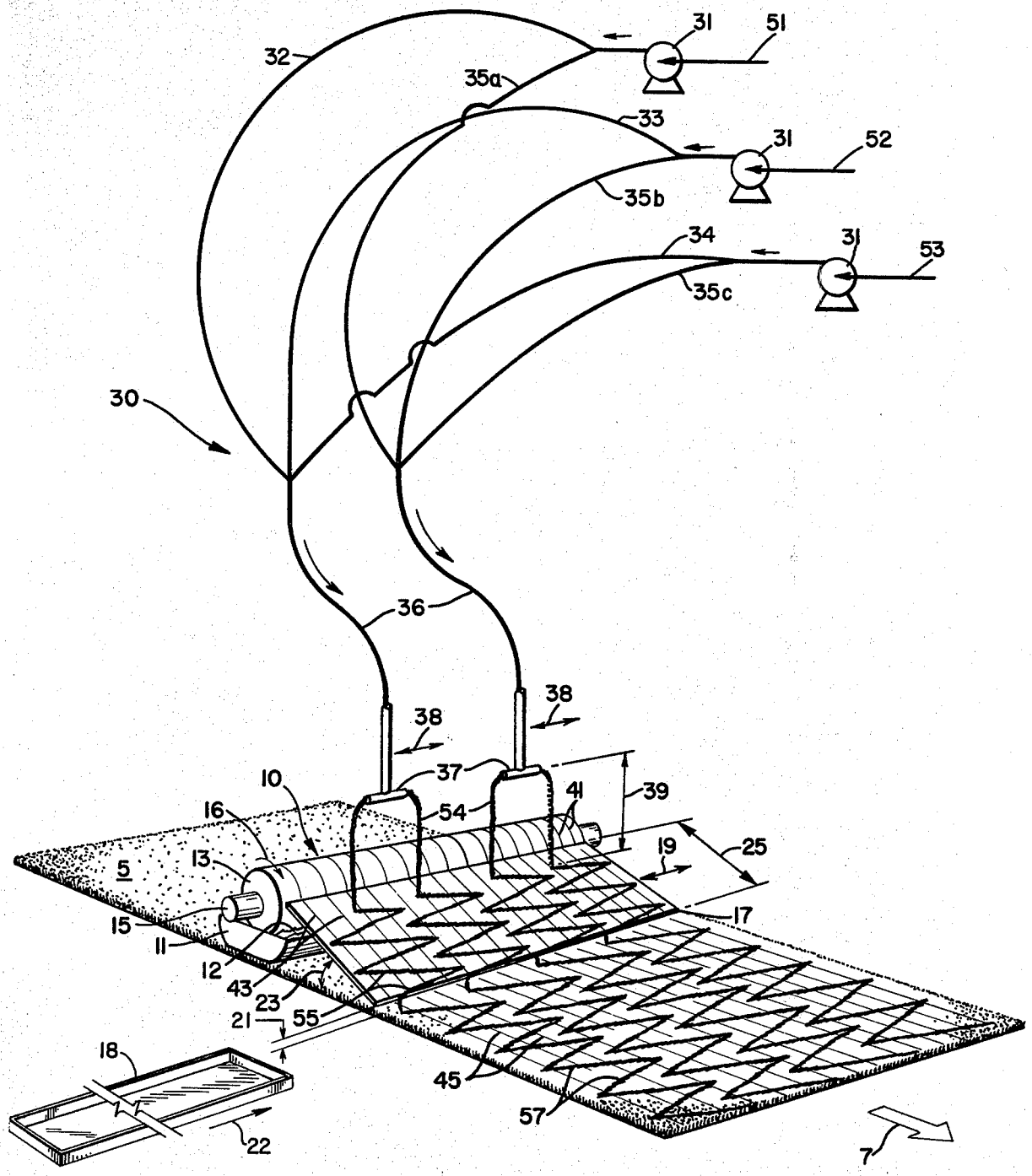
31
51
32
35a
33
31
52
35b
34
31
53
35c
30
36
38
38
37
10
41
39
16
54
19
25
5
13
17
15
11
12
43
23
21
55
18
45
57
22
7

DISTRIBUTOR FOR GEL SYSTEMS TO FORM SHARPLY DELINEATED COLOR PATTERNS UPON TEXTILE SURFACES

BACKGROUND OF THE INVENTION

1. Field of the Invention

This invention relates to multi-color dyeing of textiles and especially relates to such dyeing of carpets to obtain sharply defined color patterns thereon.

2. Review of the Prior Art

There are many decorative patterns, currently being applied to textiles, paper, and other materials by direct printing, discharge printing, silk screen printing, offset printing, and the like, which would be desirable to use on carpets. Marbleizing, veining, and such random visual effects known as segmenting and speckling are examples thereof. These decorative effects range from delicate cobwebs to impressionistic landscapes, but they have hitherto been unavailable to carpet manufacturers. The reason therefor is that it is difficult to obtain sharply defined multi-colored print effects or patterns by using randomly dispersed dyestuffs according to prior art methods, because uncontrolled colorant migration and blending cause variations in shading which detract from the appearance of the textile material.

However, a process for achieving attractive multicolor effects on textile materials with improved sharpness, uniformity and color yield and for applying sharply delineated color patterns on flat or textured or fiber-pile textile materials, substantially without the dyestuff migration that causes secondary and tertiary coloration, has been provided in U.S. Pat. No 4,264,322 which is assigned to the assignee of this application. The entire contents of U.S. Pat. No. 4,264,322 are hereby incorporated herein by reference.

This U.S. Patent provides a process for producing an aqueous gel composition, comprising an admixture of immiscible gel phases, that is adapted for applying sharply defined multicolor patterns on the suface of an article, such as a carpet. This process comprises: (1) preparing a major quantity of a first aqueous gel phase matrix which is thickened with a cationic gelling agent; and (2) dispersing in the first gel phase matrix a minor quantity of a second aqueous gel phase which is thickened with an anionic gelling agent and which contains a colorant component.

The first aqueous gel phase (i.e., the matrix phase) is present in the composition in a quantity between about 60–95 weight percent, and preferably in a quantity between about 65–90 weight percent, based on total composition weight. The second aqueous gel phase (i.e., the dispersed phase) is present in the composition in a quantity between about 5–40 weight percent, and preferably in a quantity between about 10–35 weight percent, based on total composition weight.

Two or more immiscible gel phases of the above-described second type can be dispersed in the matrix phase, wherein each of the dispersed gel phases contains a different colorant so as to provide an aqueous gel vehicle which contains a random distribution of colorant entities. The weight of the two or more dispersed gel phases can total up to about 40 weight percent of the composition.

The matrix gel phase can also contain a colorant component, preferably a dyestuff which is soluble in the matrix gel medium. The matrix gel phase can alternatively contain an anionic gelling agent, instead of a cationic gelling agent; concomitantly, the dispersed gel phase must then contain a cationic gelling agent, instead of an anionic gelling agent. The quantity of cationic or anionic gelling agent incorporated in any one of the aqueous matrix or dispersed gel phases varies in the range between about 0.05–3 weight percent, and preferably averages in the range between about 0.1–2 weight percent, based on the weight of the individual gel phases.

The term "gelling agent" means a natural or synthetic hydrocolloid which is water-soluble or water-hydratable or water-dispersible, the presence of which in an aqueous medium increases the viscosity of the aqueous medium up to and including a state of gelation.

Illustrative of suitable hydrocolloid cationic gelling agents are hydratable natural and synthetic polymers which contain a multiplicity of quaternary ammonium groups. Typical of quaternary ammonium groups are tetramethylammonium chloride and bromide, benzyltrimethylammonium chloride and bromide, tetraethylammonium chloride and bromide, tetrabutylammonium chloride and bromide, methylpyridinium chloride and bromide, benzylpyridinium chloride and bromide, trimethyl-p-chlorobenzylammonium chloride and bromide, triethanolmethylammonium chloride and bromide, and the like, wherein each of the said groups is derivatized in the form of a radical which is substituted in a hydrocolloid gelling agent by means of an alkylene or oxyalkylene linkage.

Other hydrocolloids can be employed which contain cationic groups such as acid salts of primary, secondary, and tertiary amines, or which contain phosphonium or sulfonium groups. The anion moiety associated with a cationic group include halide, sulfate, sulfonate, hydroxide, and the like.

The polymeric structure of suitable hydrocolloid cationic gelling agents include vinyl polymer and copolymers, ion exchange resins, polysaccharides, and the like. A particularly preferred class of hydrocolloids includes derivatized natural gums which contain the appropiate cationic groups. Illustrative of this class of hydrocolloids are polygalactomannan gums containing quaternary ammonium ether substituents as described in U.S. Pat. No. 4,031,307:

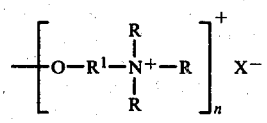

wherein R is an alkyl group containing between one and about six carbon atoms, R′ is an alkylene group containing between one and about six carbon atoms, X is chlorine or bromine, and n is an integer which correlates with the degree of substitution of the quaternary ammonium ether substituents in a polygalactomannan gum cationic gelling agent. The alkyl and alkylene group can contain other atoms such as oxygen, sulfur, and halogen.

The degree of substitution varies in the range between about 0.01–3. The term "degree of substitution" means the average substitution of ether groups per anhydro sugar unit in the polygalactomannan gums. In guar gum, the basic unit of the polymer consists of two mannose units with a glycosidic linkage and a galactose unit attached to a hydroxyl group of one of the mannose units. On the average, each of the anhydro sugar units contains three available hydroxyl sites. A degree of substitution of one means that one third of the available hydroxy sites have been substituted with ether groups.

Polygalactomannan gums are polysaccharides composed principally of galactose and mannose units and are usually found in the endosperm of leguminous seeds, such as guar, locust bean, honey locust, flame tree, and the like. Polygalactomannan gums swell readily in cold water and can be dissolved in hot water to yield solutions which characteristically have a high viscosity even at a concentration of 1–1.5 percent.

Guar flour, for example, is composed mostly of a galactomannan which is essentially a straight chain mannan with single membered galactose branches. The mannose units are linked in a 1–4-$\beta$-glycosidic linkage and the galactose branching takes place by means of a 1–6 linkage on alternate mannose units. The ratio of galactose to mannose in the guar polymer is, therefore, one to two. Guar gum has a molecular weight of about 220,000.

Locust bean gum is also a polygalactomannan gum of similar molecular structure in which the ratio of galactose to mannose is one to four. Guar and locust bean gum as supplied commercially usually have a viscosity (at 1% concentration) of around 1000 to 4000 centipoises at 25° C., using a Brookfield Viscometer Model LVF, spindle No. 2 at 6 rpm.

Also suitable are polygalactomannan gums which have been derivatized by substitution of hydroxyl groups by other ether groups, in addition to the quaternary ammonium-containing ether groups. Generally the preferred polygalactomannan ether derivatives are those which have a degree of substitution up to about 1.5.

The anionic gelling agent components of these aqueous gel compositions are hydrocolloids which have the same type of basic polymeric structure as disclosed above in the description of the cationic gelling agents, except that in place of a cationic group there is substituted an anionic group such as carboxylic acid, sulfonic acid, sulfate, and the like. Preferred cationic gelling agents include polysaccharides containing carboxyalkyl groups and synthetic polymers and copolymers containing acrylic acid, maleic acid, or benzenesulfonic acid groups, and the like.

The colorants for use in the aqueous gel compositions include the conventional anionic dyes, nonionic dyes, and cationic dyes, alone or in combination with other colorants such as pigments, powdered metals, and the like. A colorant component is present in an immiscible aqueous gel phase in a quantity which can vary from a trace amount up to about 5 weight percent or more. The average quantity of colorant in an aqueous gel phase will vary in the range between about 0.1–5 weight percent, based on the weight of aqueous gel phase. A dye colorant normally will be dissolved in the aqueous gel phase, while pigments, powdered metals, and the like are present in the form of a suspension.

Illustrative of a preferred class of colorants are disperse dyes such as are listed under the heading "Disperse Dyes" in Colour Index, 3rd Edition, Volumes 2–3, published by The American Association of Textile Chemists and Colorists.

A particularly preferred class of dyestuffs are those identified as acid dyes. A list of commercially available acid dyes is provided in Textile Chemists and Colorists (volume 8, No. 7A, pages 73–78, July 1976), a periodical published by The American Association of Textile Chemists and Colorists.

In general, it is advantageous to employ an anionic dye in an aqueous gel phase which is thickened with an anionic gelling agent, and to employ a cationic dye in an aqueous gel phase which is thickened with a cationic gelling agent.

The method which is used for dispersing a minor quantity of aqueous gel phase in a major quantity of matrix aqueous gel phase determines the resultant colorant pattern in the admixture of immiscible gel phases. Thus, a swirl or marble effect is achieved by dispersing an aqueous gel colorant phase in a matrix phase with low energy stirring, so that the dispersion is not segmented. A distribution of large specks is achieved by dispersing an aqueous gel colorant phase in a matrix phase with medium energy stirring, so that the dispersion is segmented into discrete large-size specks. A distribution of fine specks (e.g., a heather effect) is achieved by dispersing an aqueous gel colorant phase in a matrix phase with high energy stirring, so that the dispersion is segmented into discrete small-size specks.

These immiscible gel compositions of U.S. Pat. No. 4,264,322 are adapted for achieving multicolor pattern effects on rigid or non-rigid surfaces, such as textiles and particularly carpets, when employing conventional printing and coating application techniques and equipment. These immiscible gel systems are capable of providing multicolor styling of carpets which exhibit a unique combination of sharpness, uniformity, and color yield, when the carpets are dye treated in a continuous assembly such as a suitably modified Kuester-Tak apparatus.

Another process for achieving attractive multicolor effects on textile surfaces, such as carpets, with improved sharpness, uniformity, and color yield, is described in Ser. No. 062,877, filed Aug. 1, 1979; it is herein identified as the immobilized gel process. The entire contents of Ser. No. 062,877, which is assigned to the assignee of this invention, is hereby incorporated herein by reference.

The immobilized gel process utilizes an alkaline aqueous gel composition which is immobilized in the form of a random or non-random pattern, wherein the aqueous gel contains components comprising (a) a heat fixable dye, (b) a polysaccharide having adjacent cis hydroxyl groups, and (c) a borate compound which is in a crosslinking structural relationship with the polysaccharide component. The immobilized aqueous gel compositions optionally can contain one or more natural or synthetic hydrocolloid thickeners which may or may not be crosslinkable with the borate compound, e.g., water-soluble thickeners such as acrylic copolymer, poly(oxyalkylene), and the like.

This co-pending application specifically provides, for example, a process for treating and dyeing a textile material which comprises: (1) applying to the surface of the textile material an alkaline aqueous solution; (2) contacting the applied solution on the textile surface with a random or non-random pattern of an applied acidic aqueous dye solution containing a polysaccharide component having adjacent cis hydroxyl groups and containing a borate gelling agent component, wherein the said interfacing solutions together form an immobilized structural gel pattern on the textile surface; and (3) fixing the dye in the gel pattern to the textile material These component materials may be applied in any combination and any order as long as the alkaline solution, the borate gelling agent, and a polysaccharide are not brought together until all of the materials can be on the textile surface, ready to form the immobilized structural gel pattern thereon.

The term "textile material" as employed herein, with reference both to U.S. Pat. No. 4,264,322 and Ser. No. 062,877, is meant to include fabrics, fibers, yarns, and the like. Illustrative of textile materials are woven or non-woven fabrics composed of natural or synthetic hydrophobic or hydrophilic fibers and mixtures thereof.

Well known types of fibers include polyamide fibers such as nylon 6, nylon 66, and nylon 610; polyester fibers such as Dacron, Fortrel, and Kodel; acrylic fibers such as Acrilan, Orlon, and Creslan; modacrylic fibers such as Verel and Dynel; polyolefinic fibers such as polyethylene and polypropylene; cellulose ester fibers such as Arnel and Acele; polyvinyl alcohol fibers; natural fibers such as cotton and wool; man-made cellulosic fibers such as rayon and regenerated cellulose; and the like.

The dyestuffs and preferred dyestuffs that are employed in the practice of the process of Ser. No. 062,877 include the same conventional anionic dyes, nonionic dyes, and cationic dyes and combinations thereof that are described in U.S. Pat. No. 4,264,322.

With respect to the polysaccharide component recited in steps (1) and/or (2) of the process of Ser. No. 062,877, this component can be any of various water-soluble and water-dispersible polysaccharides containing adjacent cis hydroxyl groups, i.e., pairs of adjacent hydroxyl groups capable of hydrogen-bonding and crosslinking with the borate gelling agent under alkaline conditions to form a structural gel in an aqueous medium.

Illustrative of suitable polysaccharides are 1,4'-D-mannose; ivory nut mannan; alginic acid; yeast mannan; mannocarolose; glucommans; D-arabinose and D-mannose polysaccharides; D-galactose; D-mannose, and N-acetyl-D-glucoseamine polysaccharides; and the like.

The polygalactomannan gums which have been derivatized by substitution of hydroxyl groups by ether groups, as defined with reference to U.S. Pat. No. 4,264,322, are also suitable, the preferred polygalactomannan ether derivatives also being those which have a degree of substitution up to about 1.0.

Illustrative of polygalactomannan ether derivatives are those which are substituted with ether groups which include alkoxy, hydroxyalkyl, carboxyalkyl, aminoalkyl, haloalkyl, and the like.

Depending on other factors which might affect solution viscosity, the quantity of polysaccharide (e.g., polygalactomannan gum) employed in the aqueous solution (i.e., blanket solution) in step (1) of the process of Ser. No. 062,877 will vary on the average in the range between about 0.1–2 weight percent, based on the total solution weight. The quantity of polysaccharide employed in the aqueous solution (e.g., Tak drop solution) in step (2) of the process of Ser. No. 062,877 will vary on the average in the range between about 0.05–1.5 weight percent, based on the total solution weight. Only one of the solutions need contain a polysaccharide component.

The borate gelling agent component as employed in the aqueous solution of either step (1) or step (2) of the process of Ser. No. 062,877 is selected from water-soluble compounds which release borate ions in solution. Illustrative of suitable borate gelling agents are compounds described in U.S. Pat. No. 3,215,634, such as boric acid, calcium metaborate, potassium metaborate, potassium tetraborate, sodium tetraborate, sodium metaborate tetrahydrate, sodium tetraborate tetrahydrate, sodium tetraborate decahydrate, and the like. Sodium tetraborate decahydrate is sold commercially as borax.

Boric acid is a preferred borate gelling agent in the practice of the process of Ser. No. 062,877 because of its ready availability and low cost, and its effectiveness at low concentrations. The borate gelling agent is employed in a quantity between about 0.5–10 weight percent, and preferably between about 1–5 weight percent, based on the weight of polysaccharide component in a given aqueous solution. The optimal quantity of borate gelling agent to be employed is determined by such factors as the particular species of borate gelling agent selected, the quantity of polysaccharide involved, and its specific susceptibility to crosslinking interaction with the borate ions in solution.

It is believed that the crosslinking interaction involves a hydrogen bonding mechanism between adjacent cis hydroxyl groups of the polysaccharide and hydrated borate ions:

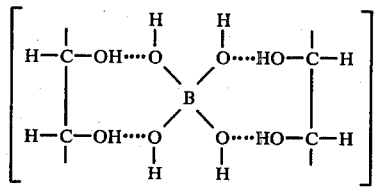

An important aspect of the process of Ser. No. 062,877 is the control of pH in the aqueous solutions being employed in steps (1) and (2) of the dyeing procedures. Thus, it is essential that initially the pH of an aqueous solution which contains both a polysaccharide and a borate gelling agent is acidic, i.e., a pH below about 7. The pH preferably is in the range between about 2–6.5, and most preferably is in the range between about 3–6.

It is also essential that the pH of the other aqueous solution involved in the process of Ser. No. 062,877, which contains a polysaccharide but not a borate gelling agent, is alkaline, i.e., a pH above about 7. The pH preferably is in the range between about 7.5–12, and most preferably is in the range between about 8–11.

As a further important requirement, it is essential that the subsequent pH is alkaline when the two solutions are successively applied wet-to-wet on the surface of a textile material, and thereafter when the two contacting liquid media blend together to form an interface zone. Under alkaline conditions, crosslinking occurs between the borate gelling agent and the polysaccharide(s), and the interface zone converts into an immobilized structural gel. Any dyestuff contained in the gel mass effectively is prevented from migrating and penetrating down into the web of the textile material.

As indicated previously, the process of Ser. No. 062,877 is adapted for achieving random and non-random multicolor pattern effects on textile materials employing conventional dye application techniques and equipment. It has particular advantage when it is contemplated for the application of multicolor effects on pile-fiber textile material, wherein the textile material is dye treated in a continuous assembly such as a commercial Kuester-Tak apparatus when suitably modified.

The process of Ser. No. 062,877 has special advantage for achieving marble, heather, and resist effects, which effects are desirable for multicolor styling of textile materials. The wet-on-wet dye systems of Ser. No. 062,877 provide dye patterns which have a unique combination of sharpness, uniformity, and color yield.

In the case of disperse dyes and acid dyes, and the like, thermal fixation of the wet-on-wet dye systems of Ser. No. 062,877 is readily accomplished by steam ageing, followed by conventional washing and drying procedures. For example, a dye treated carpet can be steam aged for 10 minutes at 215° F., washed with cold water, and then dried.

The thermal fixation of an alkaline dye-containing immobilized gel pattern on a textile surface is facilitated if the gel system contains an acid generating agent which is susceptible to heat activation, e.g., amine salt, ammonium chloride, and the like.

The Kuester apparatus, described in U.S. Pat. No. 3,541,815, comprises a dye pan having a roller immersed therein and a doctor blade to pick off the dye and deposit it as a moving film onto the tufts of the carpet as it passes beneath the trailing edge of the doctor blade.

Known modifications of the Kuester apparatus enable selected patterns to be applied to carpets. For example, U.S. Pat. Nos. 3,683,649, 3,726,640, and 3,731,503 describe means for separating the moving film into a plurality of streams which fall through an oscillating comb-like grid of wires which disperse the streams into droplets which are deposited on the continuously moving carpet passing therebeneath. The doctor blade may also be oscillated. In addition, a second dye-dispersing means, in the form of a trough having jet openings in the bottom, may be positioned above the grid and may be simultaneously oscillated on a different frequency.

A multi-color carpet dyeing process is described in U.S. Pat. No. 4,146,362. This process comprises the use of dyes having substantially different viscosities so that the second dye, having a sufficiently lower viscosity than the first dye, is not absorbed thereby when it is dispersed over the second dye. However, all such Kuester-type applications fail to provide sharply delineated colors and a multi-color pattern. Instead, the colors tend to blend to some degree when they overlap or are side by side.

There is consequently a need for an apparatus which can enable the aqueous gel systems of U.S. Pat. No. 4,264,322 and of Ser. No. 062,877 to be applied to textile surfaces, particularly to carpets, so that their unique combinations of sharpness and uniformity of pattern can be available for carpet styling. Such an apparatus must operate in accordance with the dispersion and encapsulation characteristics of the several aqueous gel phases, wherein energy must be applied in a carefully controlled manner.

SUMMARY OF THE INVENTION

In accordance with these objects and the principles of this invention, improvements to the known Kuester apparatus are herein provided that enable the aqueous gel systems disclosed in U.S. Pat. No. 4,264,322 and in Ser. No. 062,877 to be applied to carpets so that a wide variety of hitherto unavailable patterns can be obtained. This improvement comprises a smooth-surfaced doctor blade which is disposed at a selected angle to horizontal, has a selected distance between its pickup and trailing edges, and has its trailing edge a selected distance above the surface of the carpet. The doctor blade can be selectively oscillated at a selected frequency.

The improvement further comprises a feed means that forms the minor quantity of aqueous gel colorant phase as at least one free-falling stream which drops a selected distance onto a film of the major quantity of matrix aqueous gel phase which is slidingly moving downwardly over the doctor blade. The feed means may also be oscillated at a selected frequency.

The invention may also be defined as a means and method for continuously forming a desired pattern with any high-viscosity colorant system that incorporates a physical and/or chemical means to prevent blending of the colorants, and preferably that utilizes immiscible gels or immobilized gels on a smooth surface, and then for delivering the patterned mixture onto a continuously moving piece of textile material, such as a carpet. It therefore provides an off-textile means for producing a desired pattern before delivering the pattern to the carpet. This method is particularly adapted for forming swirling patterns, commonly described as "marbleized," in which the veins are selectively attenuated or broadened to produce desired effects.

The apparatus is a modified Kuester device, comprising a dye bath and roller for picking up a gel film from the dye bath, a lengthened and oscillatable doctor blade for scraping the film off the roller to form a sliding blanket on the smooth surface of the doctor blade, a mixing system for colorant gels, and an oscillatable delivery system for dropping the mixed gels onto the sliding blanket and forming a selected pattern which can be viewed and varied until it is acceptable for sliding onto the carpet which is moving at a selected small distance beneath the trailing edge of the doctor blade.

DESCRIPTION OF THE DRAWING

The invention may be more readily understood by reference to the accompanying drawing which is an isometric, schematic view of a modified Kuester apparatus for: (a) mixing up to three immiscible gels containing selected colorants, (b) feeding the mixture to an overhead delivery system, which can be oscillated, (c) dropping the mixed colors onto a blanket of flood gum which is moving down a doctor blade being oscillated to form a patterned mixture, and (d) depositing the patterned mixture onto a carpet moving continuously therebeneath.

DESCRIPTION OF THE INVENTION

Referring to the drawing, the apparatus of this invention comprises a Kuester applicator 10 having a modified doctor blade 17, a mixing and feeding means 30 for the gels and colorants, and means for oscillating both the feed delivery devices and the doctor blade. As shown in the drawing, a carpet 5 is moving in direction 7 beneath the modified Kuester-Tak device 10 which comprises a dye bath 11 containing a flood solution 12, a roller 13 having a shaft 15, and a lengthened doctor blade 17 (hereinafter termed a "slide" because sliding delivery of a gel system is its principal function) having its trailing edge a selected short distance 21 above the tops of the carpet. Roller 13 is rotating in direction 16 in a conventional manner, the drive means not being shown in the drawing.

Slide 17 is inclined at a selected angle 23 of 30°–40° to the horizontal, preferably at 35°. Length 25 of slide 17 is 10 inches to 25 inches. The preferred length is 17.5 inches. Slide 17 has a smooth top surface and is preferably made of a polished plastic material such as plexiglass. Slide 17 has selectively utilized oscillation movement 19 from an oscillation means which is not shown in the drawing.

Mixing and feeding system 30 comprises a plurality of gear pumps 31, a plurality of supply lines 51, 52, 53 which are connected to gear pumps 31, discharge lines 32, 33, 34 from gear pumps 31, which combine to form one feed line 36, discharge lines 35*a*, 35*b*, 34*c* from gear pumps 31 which combine to form a second feed line 35, and feed tees 37. By having each line 51, 52, 53 connected to its own gear pump 31, each colorant can be individually varied to obtain any desired dispersion of colorants. Feed lines 36 may alternatively be connected to a manifold, as is known in the art, without loss of the colorant dispersion. Feed tees 37 are connected to an oscillation means (not shown in the drawing), so that they possess oscillating movement 38. Tees 37 are at a selected height 39 above the surface of inclined slide 17 directly therebeneath. Height 39 is one inch to 10 inches, preferably 5 inches. Oscillation movements 19, 38 may each be varied from 0–100 percent of their range to obtain any desired cobwebby effect in the pattern. Height 21 is at least one half inch.

The apparatus of this invention operates with an immiscible color system as described in U.S. Pat. No. 4,264,322, by feeding individual colorant-containing gels 51, 52, 53 to gear pumps 31, whereby a mixture of immiscible colors is formed in feed tees 37. The mixture leaves tees 37 as falling streams 54 which drop through distance 39 onto slide 17. Although three gear pumps 31 and lines 51, 52, 53 are shown, any desired number may be used.

Meanwhile, slide 17 is operating as a doctor blade by scraping from roller 15 a relatively thick film 41 that is picked up by roller 15 from a gel solution that forms bath 12. Film 41 moves down slide 17 as film or blanket 43 and receives falling streams 54 that create lines 55 having a selectively varied shape according to frequency and range of oscillations 19, 38 and forming an easily visible pattern that can be judged as to its suitability by an observer before being deposited on a moving substrate, such as a carpet. By this procedure, startup of a printing operation on a carpet can be substantially perfect with respect to the pattern.

More specifically, when the pattern formed by lines 55 is deemed suitable, carpet 5 is moved in direction 7 to receive gel film 43 and its colorant gel or gels 55 which drop through distance 21 to form a pattern of gel 45 and gel colorants 57 thereon.

Typically, a guar gum (Celca-Gum D-48-DW, manufactured by Celanese Corporation) is used as a 1.0 percent solution for bath 12. A hydrocolloid gelling agent (Celca-Gum V-64D, Celanese which is a reaction product of 2,3-epoxypropyltrimethylammonium chloride with guar gum) is used as a 0.8 solution for one of the gel feeds 51, 52, 53. A 1.0 percent solution of a high solids emulsion, based on a mixture of carboxypolymethylene in water and mineral spirits stabilized with surfactants (Celca-Print 82, Celanese) is used as the anionic gel feed for feeds 51, 52, 53. Colorants may be used with any or all of the feeds 51, 52, 53. Different colored feeds of the same charge should contact a feed of the opposite charge before joining together to prevent diffusion of the colors.

Height 39 may be varied as desired to determine the degree of penetration of lines 55 into film 43. If height 39 is small, the colorant gels which are introduced to the apparatus as feeds 51, 52, 53 remain on top of film 43 as lines 55; as lines 57 they continue to be on top of film 45 as the gel system contacts the fibers of carpet 5 and thereby they tend to dye the tops of the fibers as film 45 sinks toward the bottoms thereof.

Instead of roller 13 and dye bath 11, any conventional system for delivering a sheet of viscous liquid to the upper edge of slide 17 may be used. For example, an overflow pan or a head box may be substituted for roller 13 and bath 11.

Similarily, a manifold or any other feeding device that will deliver streams 54 may be substituted for tees 37 and line 36. Alternatively, if a speckled pattern or a marbelized-plus-speckled pattern is desired, any device for forming droplets, such as those described in U.S. Pat. Nos. 3,683,649, 3,726,640, and 3,731,503, may be added to the system or substituted for tees 37 and lines 36.

Transversely oscillatory movements 19,38 can be circular, can follow a figure-eight pattern, or can be in accordance with any prior art figure developed by a computer. Any color vein can be broadened by a sudden burst from its pump or can be attenuated by starving the pump, as is known in the art, to produce a desired marbleizing effect. Intricate cobwebby and/or marbleized patterns 55 can be thereby formed and viewed, as on a composing screen, optionally with a light therebeneath, before delivering to carpet 5 as patterns 57.

Essentially, slide 17 functions as a forming and viewing station on which blanket 43 may receive streams 54 to form lines 55, whereby patterns may be quickly formed, evaluated, and replaced with new patterns, until a desired pattern is being formed in a stable manner for depositing on carpet 5. Moreover, if an aberration occurs in the pattern on slide 17 because of, for example, a malfunctioning pump 31, it is a simple procedure to stop carpet movement 7, to slidably insert a receiving pan 18 in direction 22 beneath the trailing edge of slide 17 whereby the gels can be caught and removed without contacting the carpet, to repair the malfunction, and finally to remove the receiving pan and resume carpet movement 7 after the desired pattern 55 reappears on slide 17. Use of a leader strip can thereby be essentially omitted and substantially perfect runs can be attained by close surveillance.

The discharged gels from the trailing edge of slide 17 can alternatively be fed to almost any feeding device instead of being dropped directly onto the surface of a moving textile. For example, the gels can be applied to a stalwart roll or into the nip of a pad roll. However, the gels cannot be satisfactorily fed to a silk screen printer.

It has been found that steeper angles 23 than 45°, such as 60°, cause the gels to drop too quickly and to slide together upon contacting the carpet, so that the desired webbing or lacy effect is destroyed. A shallower angle 23 than 35° is feasible, however, and provides more even flow of the gels without disturbance thereof. A range of 30°–40° is therefore preferable for angle 23.

This apparatus can be used for the immobilized gel process of Ser. No. 062,877 by utilizing the following procedure, for example: (a) pre-wetting the carpet substrate with a cross-linking agent, such as boric acid; (b) using as bath 12 a guar gum, such as Celca-Gum D-48-DW, manufactured by the Celanese Corporation, as a 1.0% solution at pH 6.3 and at 2000 cps viscosity, with enough ammonium hydroxide to obtain a pH of 9.1, to form film 41 and flood or blanket 43,45; and (c) adding one or more colorant gels as feeds 51,52,53.

If producing a completely marbleized pattern, by either the immiscible gel or the immobilized gel process, is not desired, it is feasible to segment the veins of any or all colorants from lines 51,52,53 by producing turbulence within any or all of lines **32,33,34,35*a*,35*b*,35*c*,36**. A simple procedure for obtaining such turbulence is to insert a static mixer within each line, as desired.

Inasmuch the present invention is subject to many variations, modifications, and changes in detail, it is intended that all matter that is described hereinbefore or shown in the accompanying drawing be interpreted as illustrative and not in a limiting sense and that the invention be limited in scope only by the accompanying claims.

What is claimed is:

1. A method for continuously forming an off-carpet multi-gel pattern, before delivery thereof to a continuously moving carpet, and for forming a sharply delineated color pattern on flat, textured, or fiber-pile carpet surfaces, substantially without dyestuff migration that causes secondary and tertiary coloration, said process comprising:

A. forming a gel blanket on an inclined slide having a smooth surface and a selected angle of inclination;

B. forming a mixture of colorant gels, said gel blanket and said colorant gels being selected from the group consisting of immiscible gels and immobilized gels;

C. dropping said mixture onto said blanket through a selected drop height of approximately 1 inch to 10 inches to form said off-carpet multi-gel pattern upon said slide having a sliding length of approximately 10 inches to 25 inches;

D. selectively and individually oscillating said mixture during said dropping;

E. selectively oscillating said blanket during said dropping to form said off-carpet multi-gel pattern;

F. viewing and judging said multi-gel pattern on said slide, said off-carpet multi-gel pattern being discarded until said pattern is judged to be substantially perfect; and G. delivering said multi-gel pattern onto said carpet through a selected delivery height to form said sharply delineated color pattern on said carpet.

2. The method of claim 1 wherein said angle of inclination is 35°–40°, said drop height is 5 inches, and said slide has a sliding length of 17.5 inches.

3. The method of claim 2, wherein said angle of inclination is 35°.

4. In the multi-color dyeing of a textile with sharply defined patterns, an off-textile forming means for producing a selected pattern of gels selected from the group consisting of immiscible gels and immobilized gels before delivery thereof to a continuously moving textile, comprising:

A. a smooth-surfaced slide which is inclined at an angle of 30°–40° and has a trailing edge which is at least approximately one-half inch above said continuously moving textile;

B. a means for producing a thin film of a gel and for delivering said film to said slide as a sliding blanket thereupon;

C. a mixing apparatus for colorant gels to produce mixed gels;

D. a delivery apparatus for dropping said mixed gels through a selected drop distance of about five inches onto said sliding blanket to form a selected pattern in which said mixed gels appear as lines having a degree of penetration into said thin film which varies directly with said drop distance;

E. oscillation means for selectively and individually oscillating said slide and said delivery apparatus; and F. a receiving pan which, when slideably inserted above said textile and beneath said trailing edge, enables said pattern to be viewed and varied until substantially perfect for dropping onto said textile without use of a leader strip therefor.

* * * * *